US005323202A

United States Patent [19]

Glover

[11] Patent Number: 5,323,202

[45] Date of Patent: Jun. 21, 1994

[54] PHOTOGRAPHIC PROCESSING APPARATUS

[75] Inventor: Edward C. T. S. Glover, London, United Kingdom

[73] Assignee: Eastman Kodak Company, Rochester, N.Y.

[21] Appl. No.: 64,089

[22] PCT Filed: Nov. 22, 1991

[86] PCT No.: PCT/EP91/02201

§ 371 Date: May 21, 1993

§ 102(e) Date: May 21, 1993

[87] PCT Pub. No.: WO92/09932

PCT Pub. Date: Jun. 11, 1992

[30] Foreign Application Priority Data

Nov. 24, 1990 [GB] United Kingdom ..... 9025598.5

[51] Int. Cl.[5] ..... G03D 3/08

[52] U.S. Cl. ..... 354/321; 354/324

[58] Field of Search ..... 354/318-324, 354/331, 336, 339; 134/64 P, 64 R, 122 P, 122 R

[56] References Cited

U.S. PATENT DOCUMENTS

| | | | |
|---|---|---|---|
| 2,401,185 | 5/1946 | Pratt et al. | 354/375 |
| 2,428,681 | 10/1947 | Pratt et al. | 354/324 |
| 3,068,774 | 12/1962 | Barstow | 354/328 |
| 3,192,846 | 7/1965 | Wright | 354/328 |
| 3,216,342 | 11/1965 | Mergens | 354/320 |
| 3,344,729 | 10/1967 | Kitrosser | 354/339 |
| 3,372,630 | 3/1968 | Schmidt | 354/319 |
| 3,516,345 | 6/1970 | Meyer | 354/325 |
| 3,610,131 | 10/1971 | Frick et al. | 354/339 |
| 3,688,677 | 9/1972 | Frick et al. | 354/339 |
| 3,774,521 | 11/1973 | Beck | 354/321 |
| 3,831,612 | 8/1974 | Limoges | 354/328 |
| 4,142,194 | 2/1979 | Hamlin | 354/318 |
| 4,166,689 | 9/1979 | Schausberger et al. | 354/321 |
| 4,327,988 | 4/1982 | Vanhorebeek et al. | 354/320 |
| 4,359,279 | 11/1982 | Popoff | 354/320 |
| 4,534,635 | 8/1983 | Johnston et al. | 354/322 |
| 4,577,949 | 3/1986 | Geyken et al. | 354/319 |

FOREIGN PATENT DOCUMENTS

| | | |
|---|---|---|
| 1200684 | 9/1965 | Fed. Rep. of Germany . |
| 1013042 | 7/1952 | France . |
| 1185411 | 7/1959 | France . |

*Primary Examiner*—D. Rutledge

*Attorney, Agent, or Firm*—Nixon, Hargrave, Devans & Doyle

[57] ABSTRACT

It is known to provide agitation of processing solutions in photographic processing apparatus using jets. Jets are also known for urging material between sets of rollers. However, such jets are not known to impart drive to material being processed as it passes through the apparatus. Described herein is an arrangement in which material (M) is transported through a narrow elongate tank (20) by means of processing solution which is directed into the tank (20) by means of high speed jets (24, 25). The jets (24, 25) have two functions, namely to drive the material (M) through the tank (20) and to supply processing solution to the tank (20) simultaneously. Such an arrangement has the advantage of providing high speed processing apparatus which occupies minimum space and has few moving parts.

7 Claims, 4 Drawing Sheets

PHOTOGRAPHIC PROCESSING APPARATUS

BACKGROUND OF THE INVENTION

This invention relates to photographic processing apparatus and is more particularly concerned with processors in which a fluid drive is used to transport the material being processed. More particularly, the apparatus includes a low volume, thin-channelled processing tank provided with at least two jets at an angle which will cause discharged fluid to advance photographic paper through the channel.

It is known to use jets to provide agitation at the surface of a material being processed. U.S. Pat. No. 3,192,846 and U.S. Pat. No. 3,774,521 both disclose the use of such jets. However, in U.S. Pat. No. 3,192,846 the jets are used to supply fluid layers to the material being processed which act as liquid bearings to prevent damage occurring during processing. Agitation is also provided by the jets. In U.S. Pat. No. 3,774,521, the jets are only used to provide agitation.

Other systems are known which employ jets, for example, those systems disclosed in U.S. Pat. Nos. 4,359,279, 3,688,677, 3,610,131, 3,344,729 and 3,516,345. In U.S. Pat. No. 4,359,279, the jets point in both directions and open out into an open tray. In U.S. Pat. No. 3,688,677 and U.S. Pat. No. 3,610,131, the jets are directed to operate in a direction which is opposite to the flow of material through the processor. In U.S. Pat. No. 3,516,345, the jets are directed to operate in a direction which is transverse to the direction of flow of the material through the processor, and in U.S. Pat. No. 3,344,729 the jets are directed at wall surfaces of the processing chamber and not at the material itself.

JP-A-2129635 discloses processing apparatus in which photosensitive material is fed from a supply reel into a slit-shaped spiral processing tank. Developing solution is pumped into the tank via two inlet nozzles or jets to transport the material being processed through the spiral tank.

It has also been known to use 'slot' or 'slit' nozzles to urge material between sets of rollers in small bench-top processing apparatus, but such nozzles have not been known to impart high speeds to the material on which they act.

SUMMARY OF THE INVENTION

It is therefore an object of the present invention to provide an arrangement in which the processing solution is directed to drive the material being processed at high speed through the processor.

According to one aspect of the present invention, there is provided photographic processing apparatus comprising a processing tank arranged to receive material to be processed and containing processing fluid, the processing tank having an inlet, an outlet and at least one pair of jets operable both to apply processing fluid to the material being processed and to drive the material through the processing tank, characterized in that an expansion box is provided at both the inlet and the outlet of the processing tank.

In this specification, processing fluid is a general term used to describe the fluid which acts upon the material being processed. Such a fluid developer solution, bleach, fix, bleach-fix, wash water or drying air.

By this arrangement, high speed processing apparatus can be provided which occupies minimum space and has few moving parts.

Advantageously, the processing tank substantially forms a loop. The loop may be mounted with its axis substantially horizontally or vertically within the apparatus.

Preferably, the jets are mounted at an angle between 30° to 45° to the direction of movement of the material being processed.

BRIEF DESCRIPTION OF THE DRAWINGS

For a better understanding of the present invention, reference will now be made, by way of example only, to the accompanying drawings in which.

DETAILED DESCRIPTION OF THE INVENTION

The apparatus of the present invention can be used for any suitable processing stage of the processing apparatus, for example, in the developing, bleaching, fixing, bleach-fixing, washing or drying stages.

Figure 1:
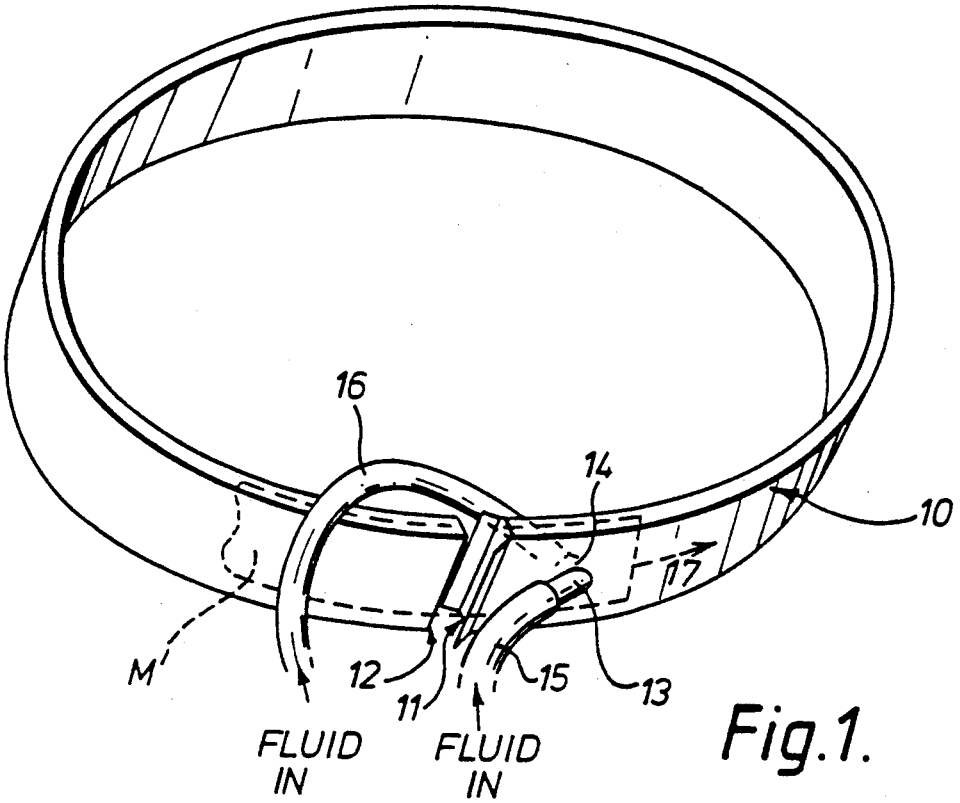
FIG. 1 is a schematic view of a horizontally mounted processing tank constructed in accordance with the present invention.

In FIG. 1, an elongate, narrow, low volume processing tank 10 is shown. This tank was constructed for the purpose of demonstrating that fluid drive was possible. In practice, this arrangement can be used but only if mounted such that it is totally submerged in processing fluid contained in a vessel.

The tank 10 has the configuration of an almost closed loop, the loop having openings 11, 12 which permit the entry and exit respectively of material to be processed. The tank 10 is submerged in a vessel (not shown) with its axis sustantially vertical. Two jets 13, 14 (only jet 13 can be seen in FIG. 1) are positioned one either side of the tank 10, each jet being connected via pipework 15, 16 to a supply of processing solution (not shown). Material to be processed, shown by dotted lines and labelled M, is directed through the tank 10 in the direction of arrow 17.

Figure 2:
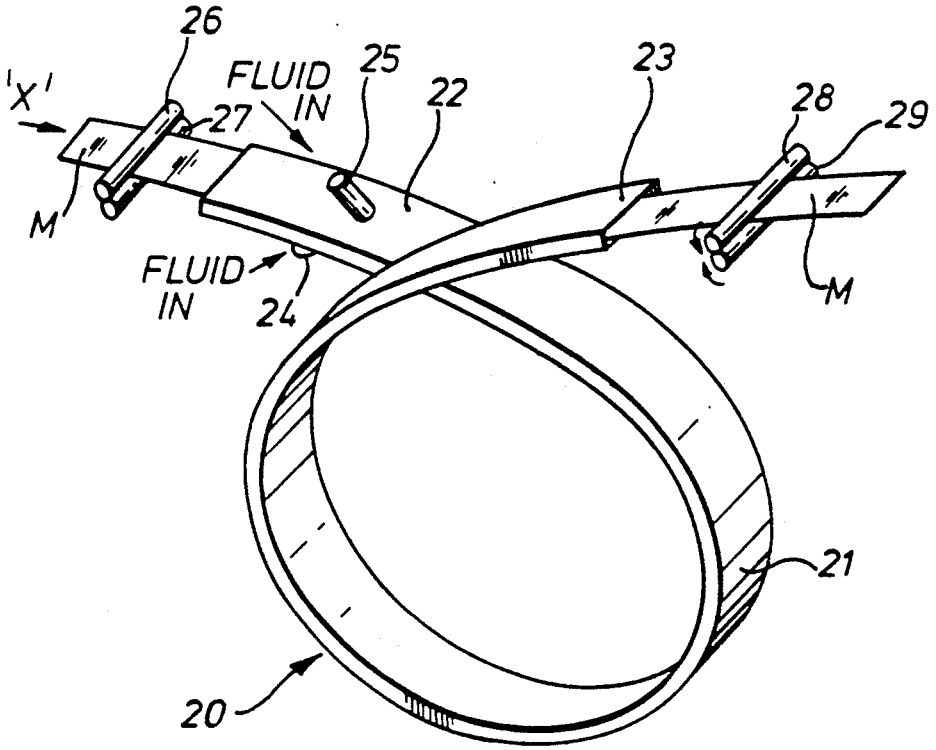
FIG. 2 is a schematic view of a vertically mounted processing tank constructed in accordance with the present invention.

In FIG. 2, a similar but more practical arrangement is shown. In this case, processing tank 20 is formed into a spiral, as shown, having a loop portion 21 and two portions 22, 23 adjoining portion 21. The axis for the loop portion 21 is mounted to be substantially horizontal. As before, two jets 24, 25 are positioned one either side of the tank 20, and are connected to a supply of processing solution (not shown). Rollers 26, 27 and 28, 29 respectively guide material M into and out of the tank 20. Material M enters the tank 20 in the direction shown by arrow 'X'.

Although rollers 26, 27 and 28, 29 are shown in FIG. 2, it is important to note that they do not impart any substantial drive to the material M as it passes through the processing tank 20. However, the rollers 26, 27, 28, 29 are metering rollers in that they provide control for the material M as it passes through the tank 20.

Figure 3:
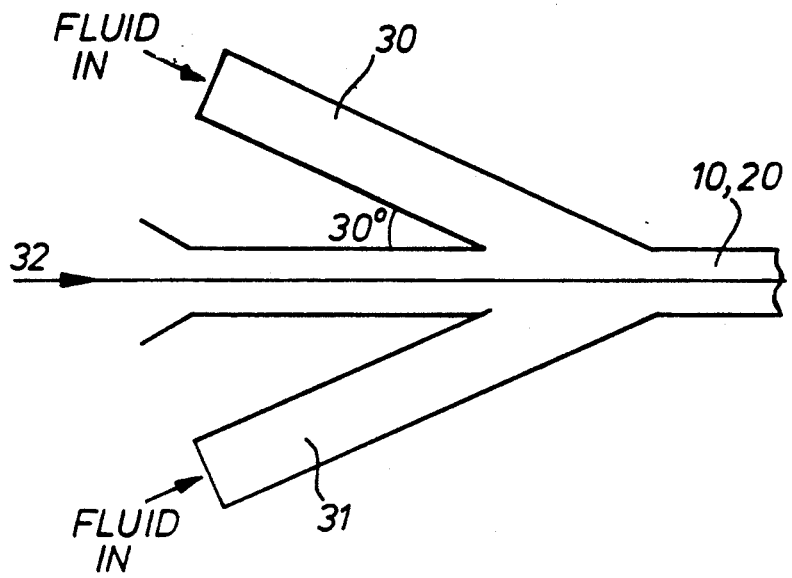
FIGS. 3 and 4 are sectioned views through a processing tank of either FIG. 1 or 2 in the region of their respective drive units, and illustrates two possible angles for the jets relative to the direction of movement of the material being processed.

FIG. 3 shows jets 30, 31 which are positioned at an angle of 30° to the processing tank 10 (FIG. 1) or 20 (FIG. 2). The direction of movement of the material being processed is indicated by arrow 32.

Figure 4:
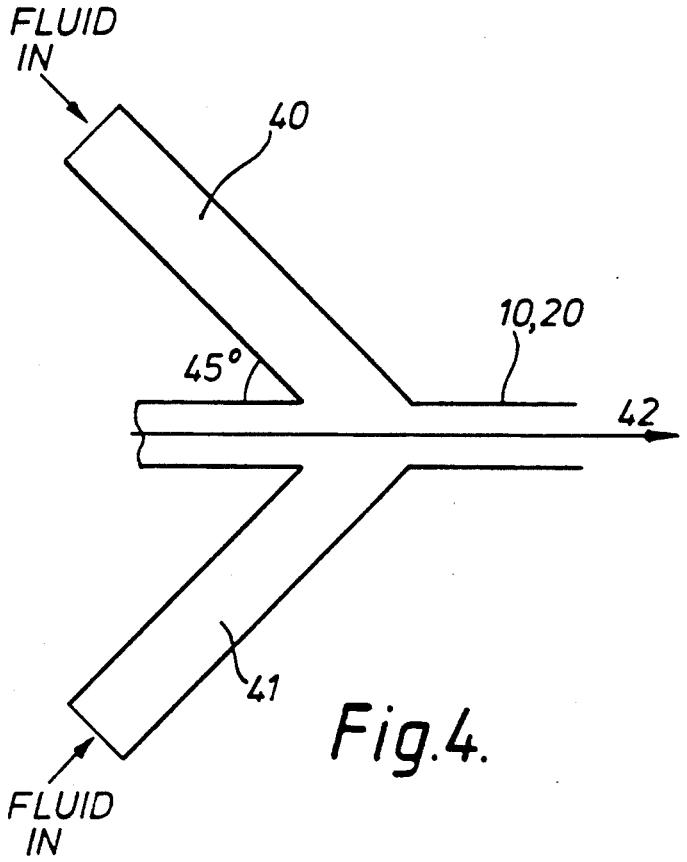

FIG. 4 shows jets 40, 41 which are positioned at an angle of 45° to the processing tank 10 (FIG. 1) or 20 (FIG. 2). The direction of movement of the material being processed is indicated by arrow 42.

Figure 5:
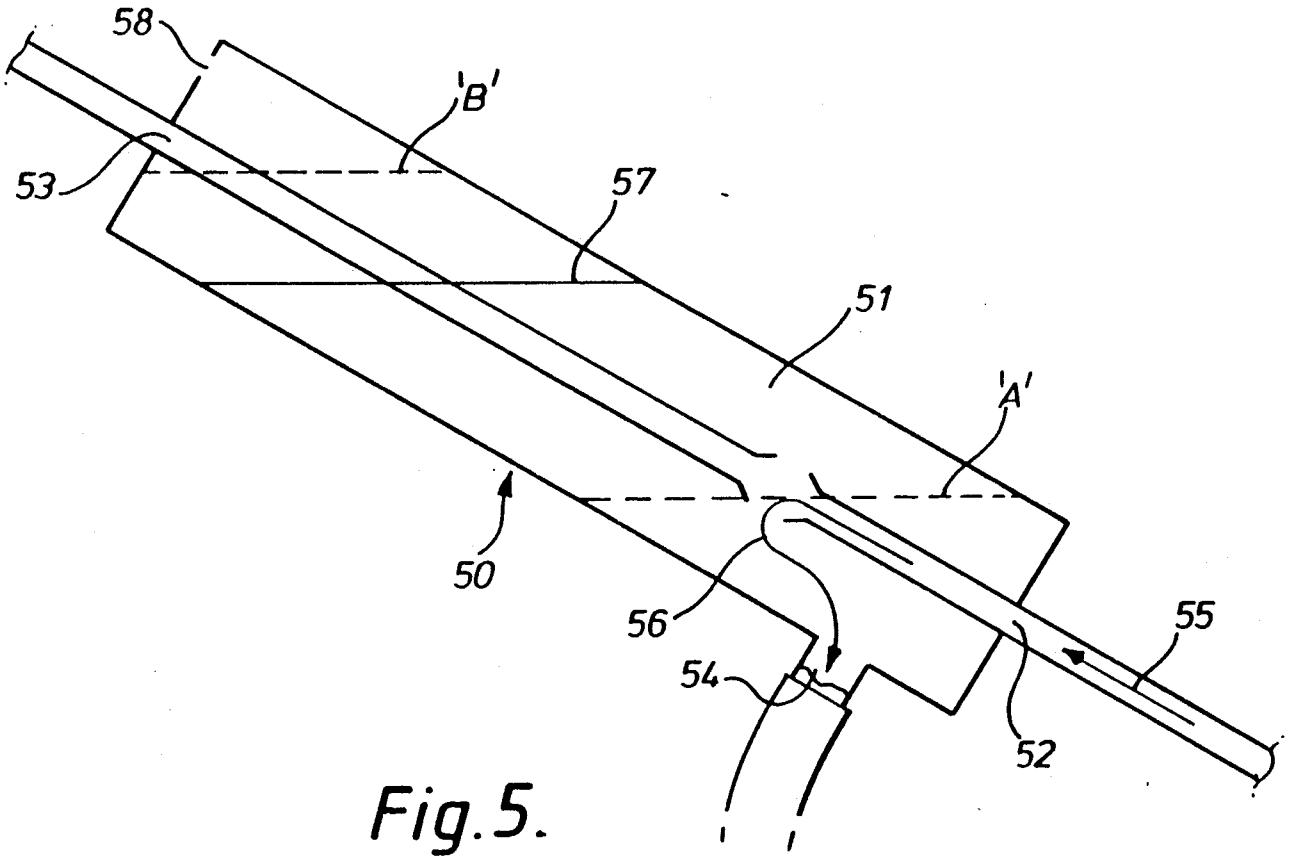
FIG. 5 illustrates an expansion box for connection to one end of a processing tank.

FIG. 5 illustrates an expansion box 50 which is used to relieve the build-up of pressure in the processing tank 20 at the respective inlets and outlets. The box 50 comprises a chamber 51 having an inlet member 52 and an outlet member 53 through which the material being processed enters and leaves the box respectively. The inlet and outlet members 52, 53 may be reversed, that is, the inlet member may be 53 and the outlet member be 52. The inlet and outlet members 52, 53 may form part of the processing tank (not shown). Alternatively, these members 52, 53 may comprise guides which direct the material into and out of the box 50.

A connection 54 is made to the recirculation system of the processing tank (not shown) to recirculate fluid which has expanded into the chamber 51. A vent hole 58 is provided in box 50 to allow air to be pushed out of the chamber 51 as fluid enters the chamber from the tank.

When the box 50 is being used at the inlet side of a processing tank, material being processed enters the box 50 through member 53 and out through member 52. Fluid in member 52 is displaced due to the entry of the material into that member and the back pressure generated by the drive jets associated with that tank (not shown), and the fluid moves in the direction indicated by arrow 55, into the box 50, and out into the chamber 51 in the direction indicated by arrow 56. The fluid then flows into the connection 54.

When the box 50 is used at the outlet side of a processing tank, material being processed enters the box 50 through member 52 and out through member 53. Fluid in member 52 is displaced due flow from the tank. As before, the fluid moves in the direction indicated by arrow 55, into the box 50, and out into the chamber 51 in the direction indicated by arrow 56. The fluid then flows into the connection 54 as described above.

This arrangement prevents the escape of processing fluid, for example a liquid, out of the expansion box through the member 53 whether it is being used as an inlet or an outlet device. Processing solutions may attain a level 57 within the chamber 51 which may lie between the maximum and minimum levels as indicated by levels 'A' and 'B' as shown.

Figure 6:
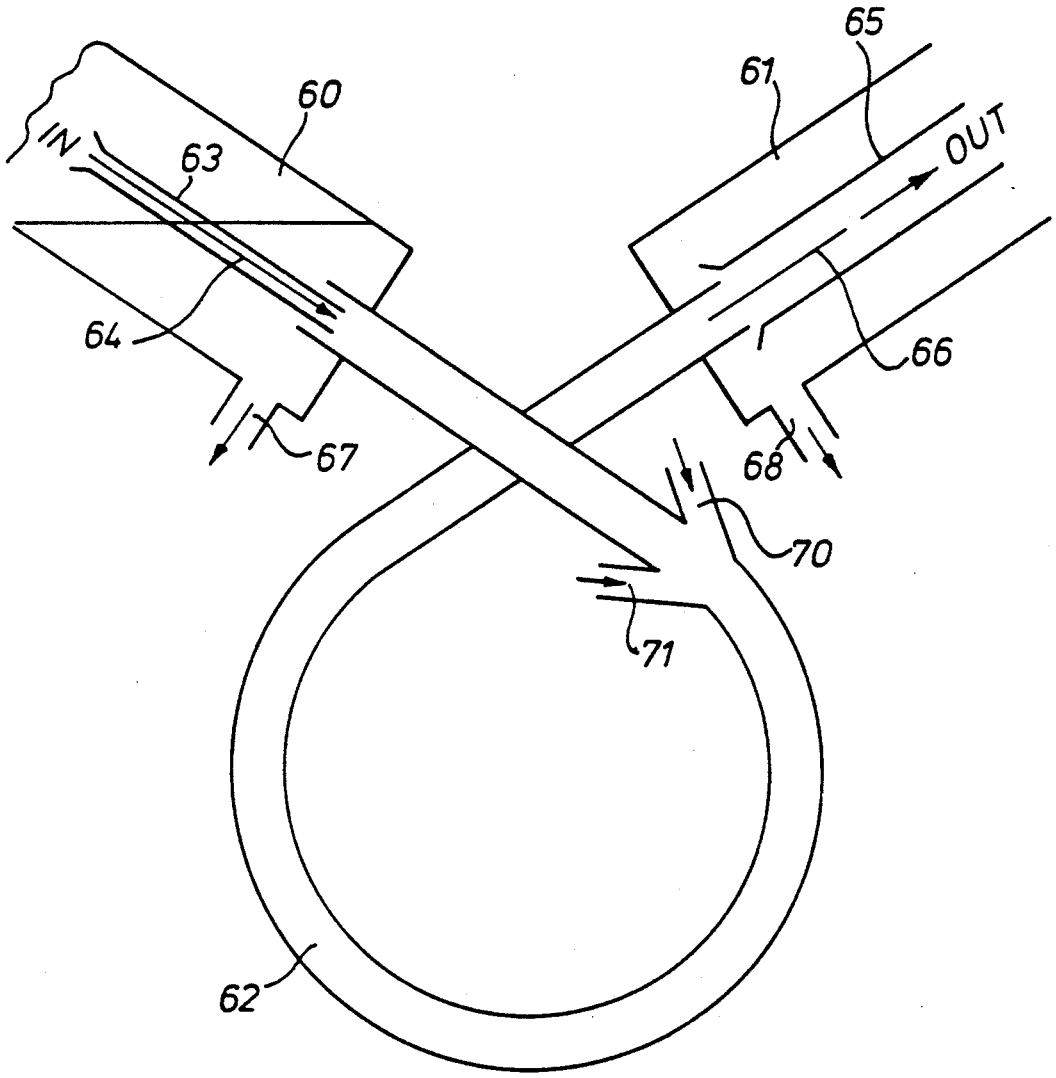
FIG. 6 illustrates the expansion box shown in FIG. 5 in association with a vertically mounted processing tank.

In FIG. 6, an arrangement is shown in which an expansion box 60, 61 is provided at each end of a vertically mounted processing tank 62. Box 60 provides an inlet to the tank 62. A guide 63 directs material, in the direction shown by arrow 64, into the tank 62 for processing. Similarly, box 61 provides an outlet to the tank 62 with a guide 65 directing the material, in the direction of arrow 66, out of the tank 62 and to the next processing stage where appropriate. Both boxes 60, 61 are provided with respective connections 67, 68 to the recirculation system (not shown), which in turn is connected to jets 70, 71.

It is to be noted that the jets 30, 31 of FIG. 3 and the jets 40, 41 of FIG. 4 correspond to the jets 13, 14 and 24, 25 of FIGS. 1 and 2.

Although FIGS. 3 and 4 illustrate jets being positioned at an angle of 30° or 45° to the direction of motion of the material being processed, other angles between these two values can also be used.

The pressure of processing solution supply supplied to the jets is approximately 0.21MPa (30 psi). This produces linear speeds in the region of 1.5 $ms^{-1}$ (300 $ftmin^{-1}$) with jets having a diameter of approximately 9.5 mm (0.375 in). Naturally, other pressure values and jet diameters may be useful, and other linear speeds may be attainable.

The present invention can be applied to any processing apparatus in which sheets or webs of material are required to be moved along relatively large distances in narrow tanks.

It is to be noted that although, loops and spirals have been described for the configuration of the processing tanks, other configurations are also possible.

Furthermore, apparatus according to the invention can be extended to any situation where there is not enough drive imparted to the material by conventional means.

I claim:

1. Photographic processing apparatus comprising a processing tank arranged to receive material to be processed and containing processing fluid, the processing tank having an inlet, an outlet and at least one pair of jets operable both to apply processing fluid to the material being processed and to drive the material through the processing tank, characterized in that an expansion box is provided at both the inlet and the outlet of the processing tank.

2. Apparatus according to claim 1, wherein each expansion box includes a guide member for guiding the material being processed into and out of the processing tank.

3. Apparatus according to claim 1, wherein the processing tank substantially forms a loop.

4. Apparatus according to claim 3, wherein the loop is mounted substantially horizontally within the apparatus.

5. Apparatus according to claim 3, wherein the loop is mounted substantially vertically within the apparatus.

6. Apparatus according to claim 1, wherein the jets are mounted at an angle between 30° to 40°.

7. Apparatus according to claim 1, wherein the processing tank is of low volume.

* * * * *

UNITED STATES PATENT AND TRADEMARK OFFICE

CERTIFICATE OF CORRECTION

PATENT NO. : 5,323,202
DATED : June 21, 1994
INVENTOR(S) : Glover

It is certified that error appears in the above-indentified patent and that said Letters Patent is hereby corrected as shown below:

In Column 4, line 56, delete "40°" and insert --45°--.

Signed and Sealed this

Third Day of January, 1995

*Attest:*

Bruce Lehman

BRUCE LEHMAN

*Attesting Officer*

*Commissioner of Patents and Trademarks*